US007287992B2

(12) United States Patent
Chawgo

(10) Patent No.: US 7,287,992 B2
(45) Date of Patent: Oct. 30, 2007

(54) PROTECTIVE CAP FOR COAXIAL CABLE PORT TERMINATOR

(75) Inventor: Shawn Chawgo, Liverpool, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/261,282

(22) Filed: Oct. 28, 2005

(65) Prior Publication Data

US 2007/0099456 A1 May 3, 2007

(51) Int. Cl.
*H01R 13/44* (2006.01)

(52) U.S. Cl. ..... 439/135

(58) Field of Classification Search ..... 439/135, 439/134, 143, 149
See application file for complete search history.

(56) References Cited

U.S. PATENT DOCUMENTS

| | | | | | |
|---|---|---|---|---|---|
| 2,337,781 | A | | 12/1943 | Stoker | |
| 2,914,650 | A | * | 11/1959 | Sheahan | 219/436 |
| 2,926,330 | A | * | 2/1960 | Newcombe | 439/728 |
| 3,427,550 | A | * | 2/1969 | Helda et al. | 439/149 |
| 3,633,150 | A | | 1/1972 | Swartz | |
| 3,750,090 | A | | 7/1973 | Teman | |
| 4,049,902 | A | | 9/1977 | de Ronde | |
| 4,258,970 | A | * | 3/1981 | Bourdon et al. | 439/149 |
| 4,261,630 | A | | 4/1981 | Knappenberger | |
| 4,278,312 | A | * | 7/1981 | Buffa | 439/135 |
| 4,385,792 | A | | 5/1983 | Baur et al. | |
| 4,423,918 | A | | 1/1984 | Filreis et al. | |
| 4,469,386 | A | | 9/1984 | Ackerman | |
| 5,069,636 | A | * | 12/1991 | Shimirak et al. | 439/412 |
| 5,147,219 | A | | 9/1992 | Gilberts et al. | |
| 5,173,057 | A | * | 12/1992 | Bunch et al. | 439/217 |
| 5,435,736 | A | | 7/1995 | McMills et al. | |
| 5,573,412 | A | | 11/1996 | Anthony | |
| 5,655,915 | A | * | 8/1997 | McMills et al. | 439/133 |
| 5,936,202 | A | | 8/1999 | Yovan | |
| 5,993,266 | A | * | 11/1999 | Mayer et al. | 439/680 |
| 6,062,897 | A | | 5/2000 | McCarthy | |
| 6,203,360 | B1 | * | 3/2001 | Harting et al. | 439/412 |
| 6,309,246 | B1 | * | 10/2001 | Keaton et al. | 439/509 |
| 6,416,337 | B1 | | 7/2002 | Fan | |
| 6,447,319 | B1 | * | 9/2002 | Bodin | 439/314 |
| 6,672,422 | B2 | | 1/2004 | Baker et al. | |
| 2004/0219838 | A1 | * | 11/2004 | Kooiman | 439/620 |

* cited by examiner

*Primary Examiner*—Tulsidas C. Patel
*Assistant Examiner*—Vladimir Imas
(74) *Attorney, Agent, or Firm*—Christopher R. Pastel; Pastel Law Firm

(57) ABSTRACT

A protective cap includes first and second sealing sections, with the first section fitting into the end of a port terminator which contains a center conductor pin and the second section fitting into the end of the port terminator which contains a deep bore which accommodates a security tool used to lock and unlock the port terminator from a port. The protective cap can thus be used to protect the center conductor pin during shipping and then be used to cap the bore of the port terminator upon installation of the terminator in a multiport tap.

13 Claims, 7 Drawing Sheets

PROTECTIVE CAP FOR COAXIAL CABLE PORT TERMINATOR

FIELD OF THE INVENTION

This invention relates generally to the field of devices used with coaxial cable transmission systems, and more particularly to a protective cap for a coaxial cable port terminator.

BACKGROUND OF THE INVENTION

In a typical cable television (CATV) system, multi-port taps don't always have every port used (active). A common way of securing an unused (inactive) port is to use a locking port terminator or a locking port cap. The "locking" feature is to prevent unauthorized persons from gaining access to the CATV system. Most locking port terminators and port caps have a deep bore that accepts a specialty tool which is required for installation and removal. Unfortunately, the geometry of the deep bore makes it a convenient place for insects to lodge. The presence of insects, whether dead or alive, interferes with proper use of the specialty tool.

SUMMARY OF THE INVENTION

Briefly stated, a protective cap includes first and second sealing sections, with the first section fitting into the end of a port terminator which contains the center conductor pin and the second section fitting into the end of the port terminator which contains the deep bore which accommodates the security tool used to lock and unlock the port terminator from the port. The protective cap can thus be used to protect the center conductor pin during shipping and then be used to cap the bore of the port terminator upon installation of the terminator in the multiport tap.

According to an embodiment of the invention, a device includes a protective cap having first and second sealing sections and a third section, wherein the first sealing section fits into an end of the port terminator which contains a center conductor pin and the second sealing section fits into an end of the port terminator which contains a bore which accommodates a security tool used to lock and unlock the port terminator from a port.

According to an embodiment of the invention, a method of manufacturing a protective cap includes the step of forming first and second sealing sections and a third section, wherein the first sealing section fits into an end of the port terminator which contains a center conductor pin and wherein the second sealing section fits into an end of the port terminator which contains a bore which accommodates a security tool used to lock and unlock the port terminator from a port.

DETAILED DESCRIPTION OF THE PREFERRED EMBODIMENT

Figure 1:
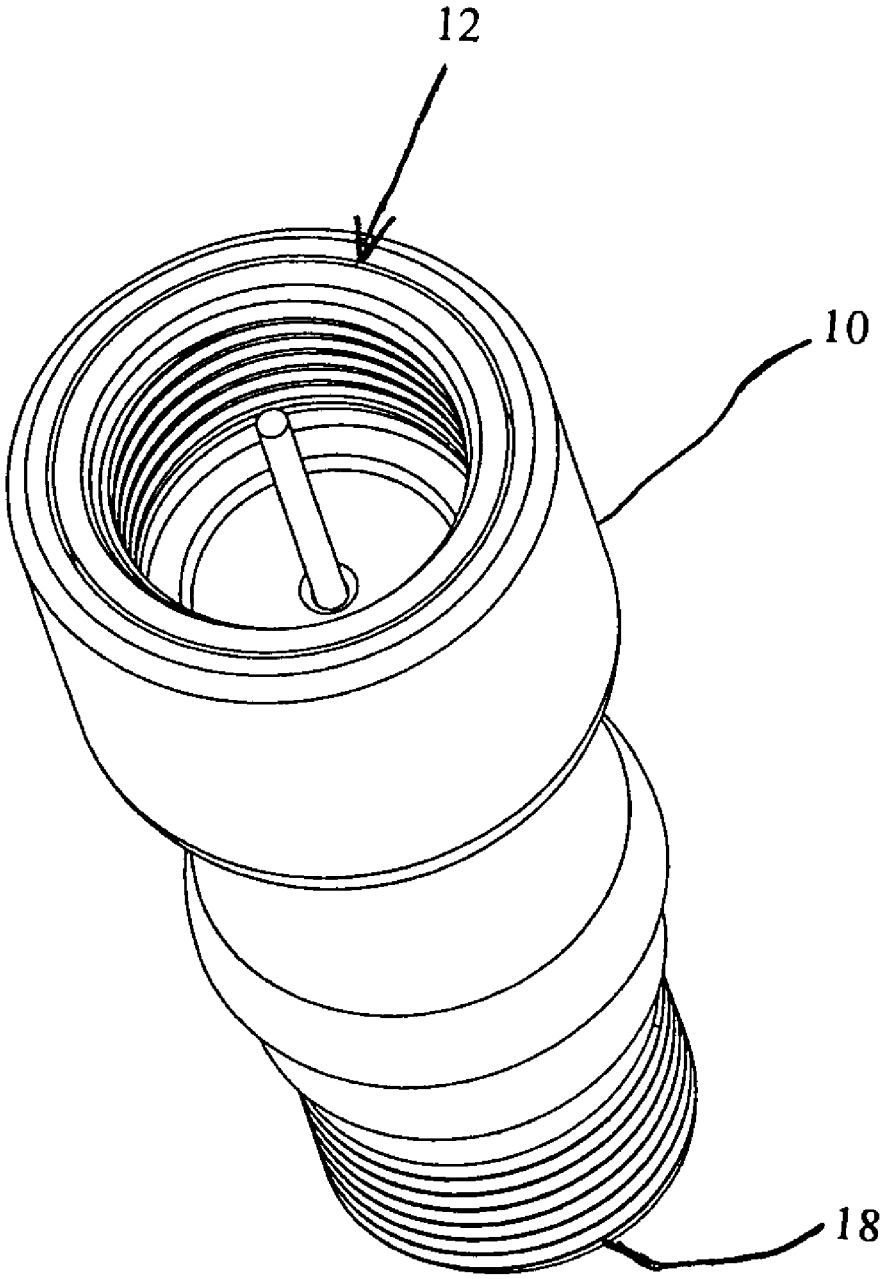
PRIOR ART Fig. 1
FIG. 1 shows a perspective view of a port terminator according to the prior art.
Figure 2:
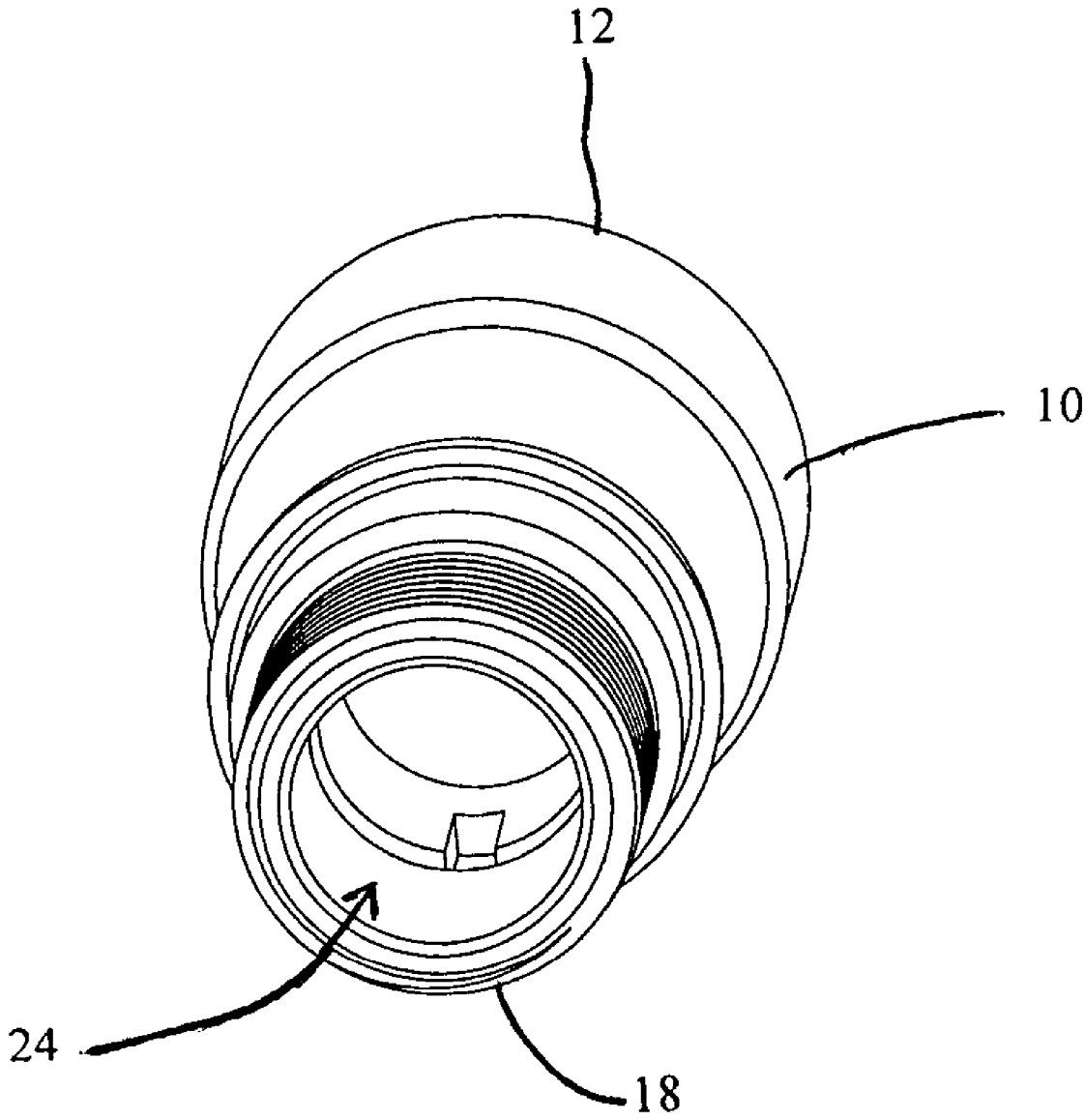
PRIOR ART Fig. 2
FIG. 2 shows a different perspective view of the port terminator of FIG. 1.

Referring to FIGS. 1-2, a port terminator 10 is used to close off an unused coax port in a multiport tap (not shown). Port terminator 10 contains a center conductor 16. During installation, an end 12 is screwed onto the port using a specialty tool (not shown) which fits into a deep bore 24 at an end 18. Two problems can arise during use. First, center conductor 16 at end 12 can get bent during shipping to a customer. Second, when end 12 is connected to the multiport tap, deep bore 24 becomes a favored lodging for insects. A specialty tool is used to remove port terminator 10 when the port is required to connect cable access; the specialty tool helps prevent theft of cable services, but the insects that lodge in the deep bore of end 18 interfere with the proper functioning of the specialty tool.

Figure 3:
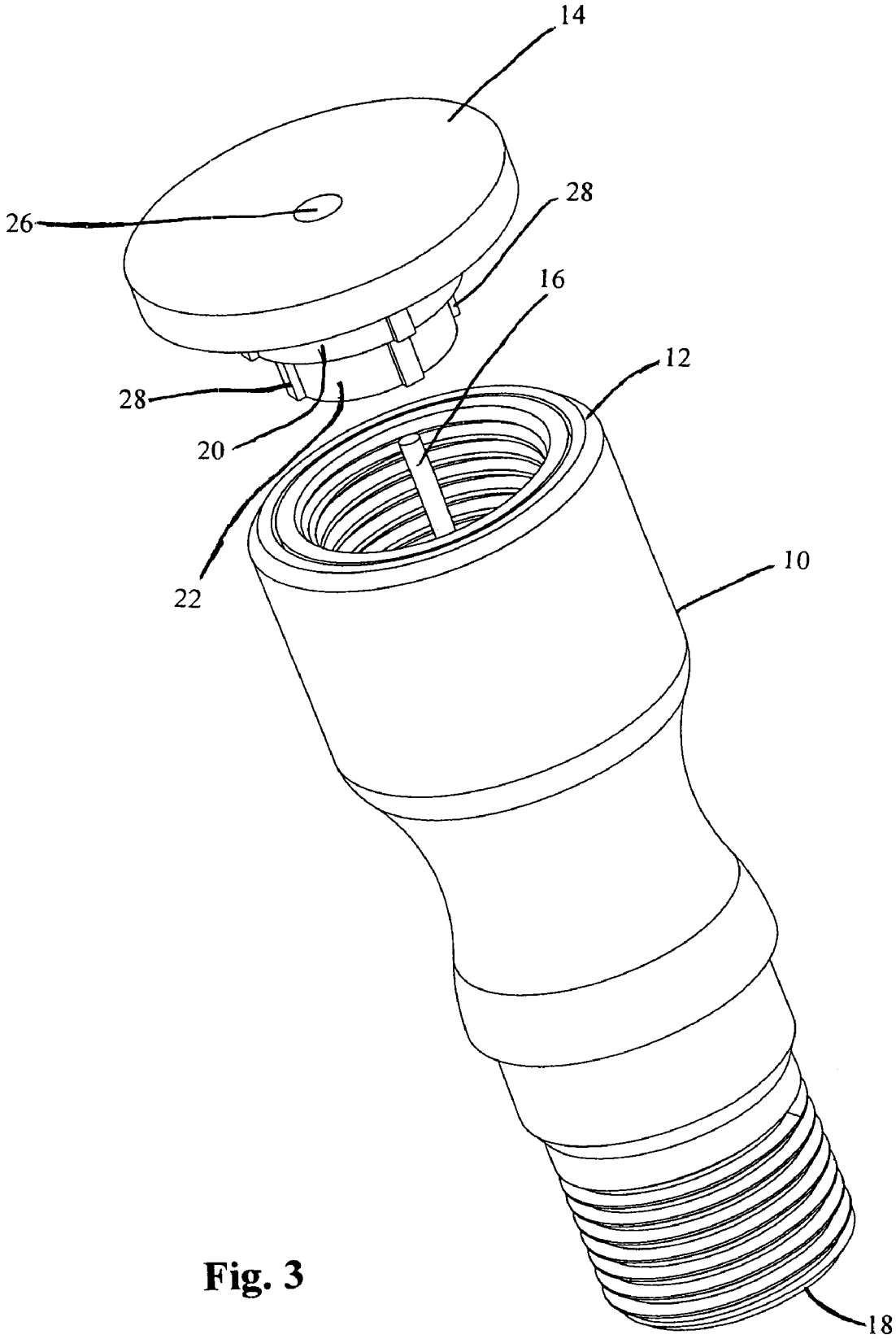
FIG. 3 shows a perspective view of a protective cap according to an embodiment of the invention in relation to a first end of the port terminator.

Referring to FIG. 3, a protective cap 14 includes two sealing sections. A first section 20 which fits into end 12, while a second section 22 fits into end 18. Protective cap 14 preferably contains a hole 26 through which a portion of center conductor 16 protrudes when protective cap 14 is emplaced into end 12. A plurality of ridges 28, preferably of the same material as cap 14 and preferably one-piece with cap 14, help insure an interference fit between protective cap 14 and port terminator 10. Note that ends 12 and 18 as shown in FIGS. 1-2 are of different diameters, so that first section 20 is sized to friction-fit into end 12 while second section 22 is sized to friction-fit into end 18.

Protective cap 14 can thus be used to protect center conductor 16 at end 12 during shipping and then be used to cap 18 upon installation in the multiport tap. The same cap 14 can be mounted on either end of the port terminator.

Figure 4:
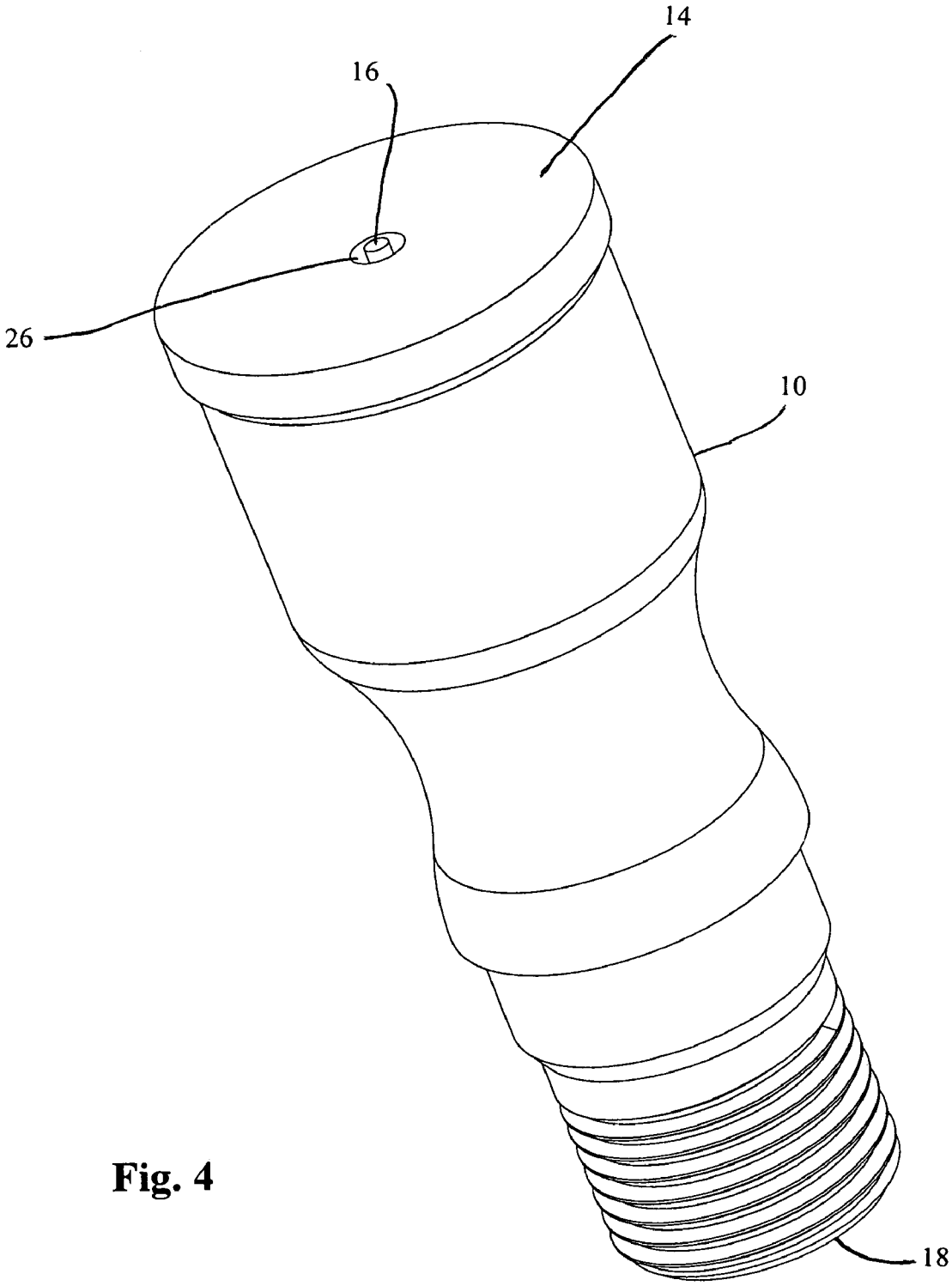
FIG. 4 shows a perspective view of the protective cap of FIG. 3 installed on the first end of the port terminator.

Referring to FIG. 4, protective cap 14 is shown installed onto end 12 of port terminator 10.

Figure 5:
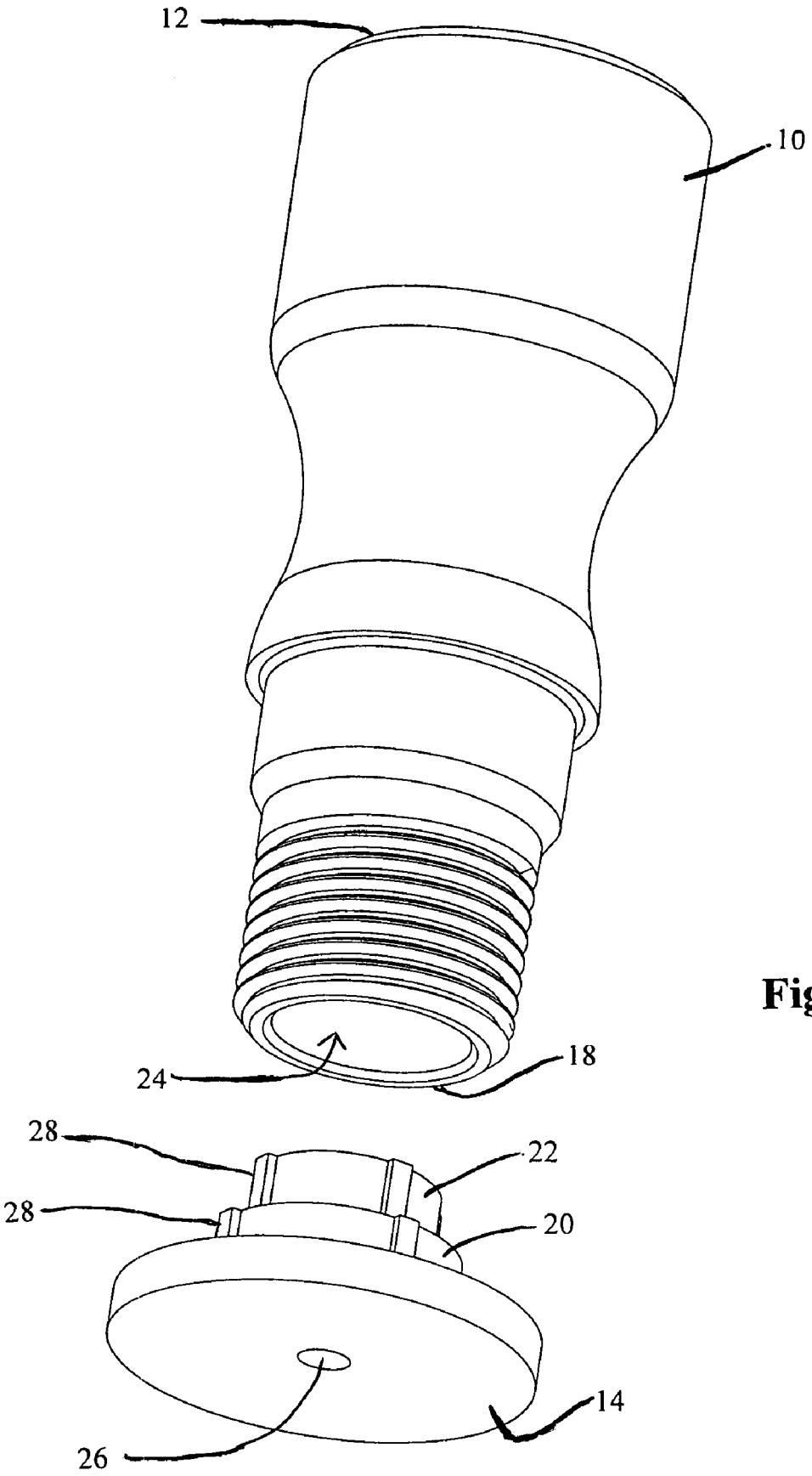
FIG. 5 shows a perspective view of the protective cap of FIG. 3 in relation to a second end of the port terminator.

Referring to FIG. 5, protective cap 14 is shown ready to be installed onto end 18 of port terminator 10 to cover bore 24.

Figure 6:
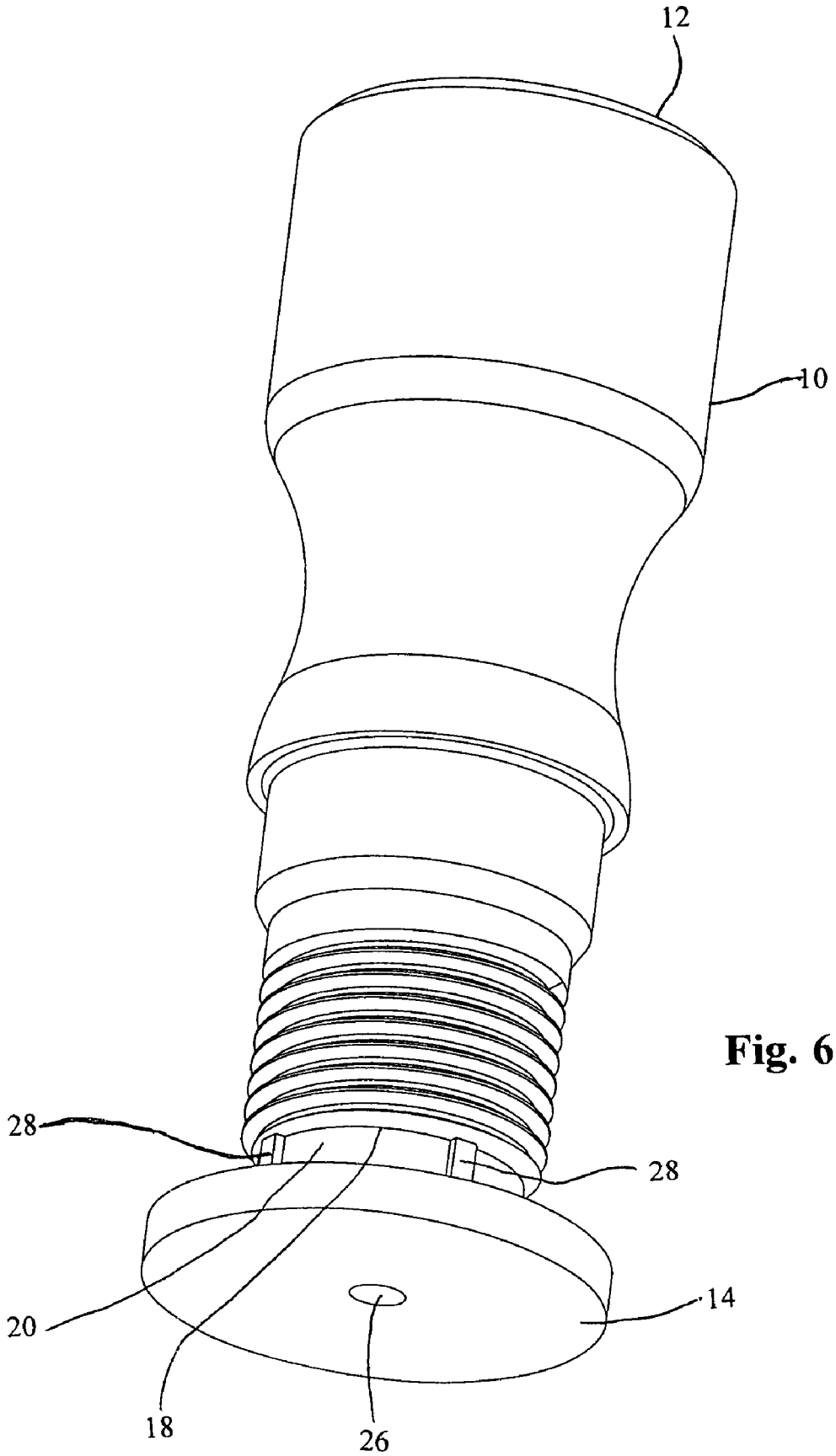
FIG. 6 shows a perspective view of the protective cap of FIG. 3 installed on the second end of the port terminator.

Referring to FIG. 6, protective cap 14 is shown installed onto port terminator 10. Note that second section 22 is not visible in FIG. 6 because it is inside end 18, while first section 20 remains visible. Bore 24 is thus completely covered by protective cap 14.

Figure 7:
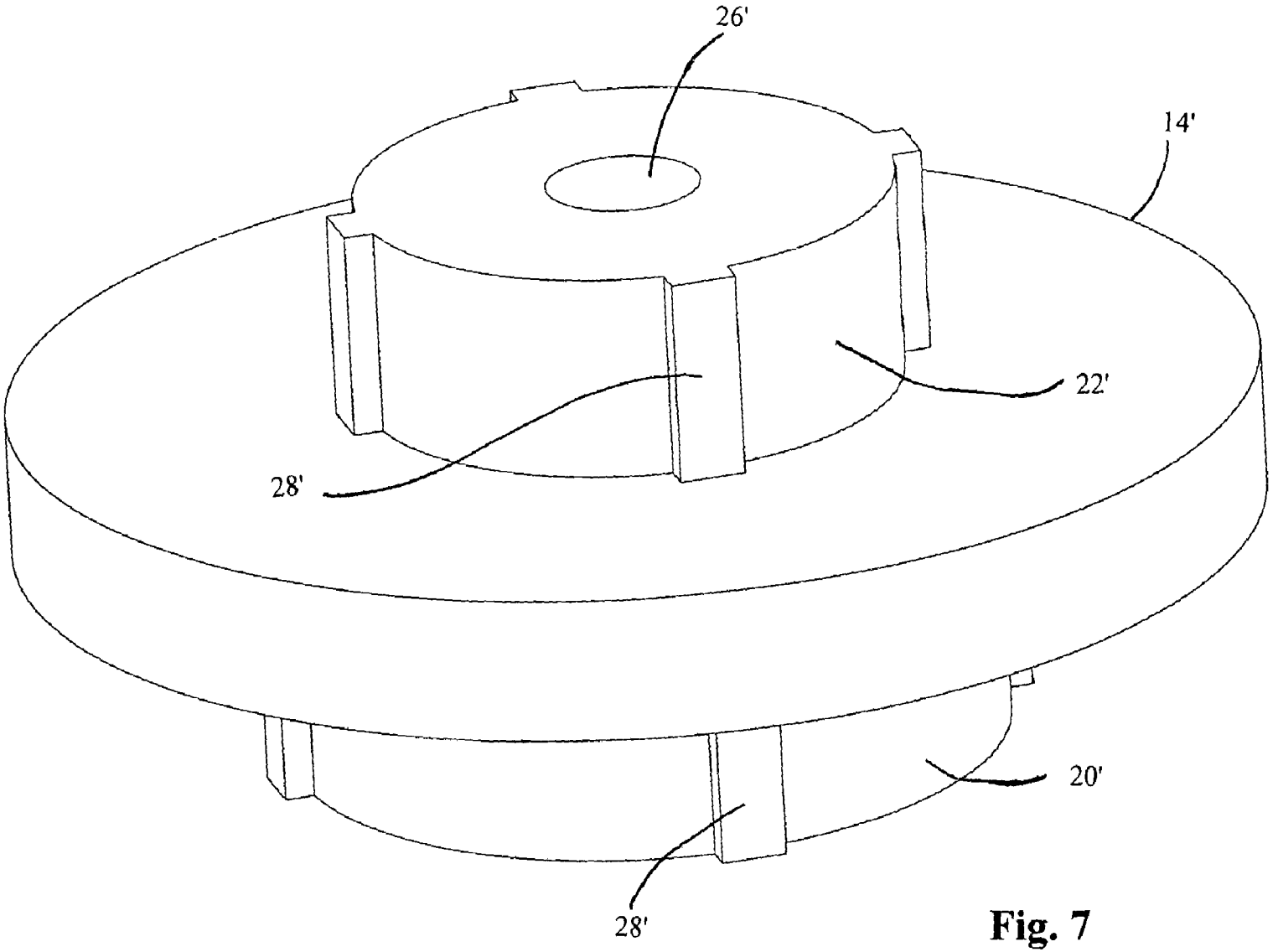
FIG. 7 shows a perspective view of a protective cap according to an alternate embodiment of the invention.

Referring to FIG. 7, another embodiment of the invention is shown. A protective cap 14' includes a first section 20' and a second section 22'. First section 20' fits into end 12 of port terminator 10, while second section 22' fits into end 18 of port terminator 10. A plurality of ridges 28', preferably of the same material as cap 14' and preferably one-piece with cap 14', help insure an interference fit between protective cap 14' and port terminator 10. A hole 26' permits center conductor 16 to fit therein.

Protective cap 14 is preferably made of polyethylene. Other plastics could be used, including acetal resin (Delrin®), or optionally metal with an O-ring in a groove to hold the cap into the back of terminator 10.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A device comprising a protective cap having first and second sealing sections and a third section, wherein the first sealing section is adjacent the third section, wherein the third section has a larger outer diameter than an outer diameter of the first sealing section and an outer diameter of the second sealing section, wherein the outer diameter of the first sealing section is larger than the outer diameter of the second sealing section, wherein the first sealing section is fittable into an end of a port terminator having one end which contains a center conductor pin and an opposite end which contains a bore which accommodates a security tool used to lock and unlock the port terminator from a port; and wherein the second sealing section is fittable into the opposite end of the port terminator; wherein the device further comprises a plurality of ridges on the first and second sealing sections; and wherein the ridges are perpendicular to a plane of the third section of the protective cap.

2. A device according to claim 1, wherein the plurality of ridges are one-piece with the first and second sealing sections and the first and second sealing sections are one-piece with the third section of the protective cap.

3. A device comprising a protective cap having first and second sealing sections and a third section, wherein the first sealing section is directly adjacent the third section, wherein the third section has a larger outer diameter than an outer diameter of the first sealing section and an outer diameter of the second sealing section, wherein the outer diameter of the first sealing section is larger than the outer diameter of the second sealing section, wherein the first sealing section is fittable into an end of a port terminator having one end which contains a center conductor pin and an opposite end which contains a bore which accommodates a security tool used to lock and unlock the port terminator from a port; wherein the second scaling section is fittable into the opposite end of the port terminator; and wherein the first and second sealing sections are on opposite sides of the third section of the protective cap.

4. A device according to claim 1, wherein the protective cap is made of a plastic.

5. A device according to claim 1, wherein the protective cap is made of polyethylene.

6. A device according to claim 1, wherein the protective cap is made of metal.

7. A device according to claim 1, wherein the first sealing section includes a hole therein to accommodate the center conductor pin of the port terminator.

8. A method of manufacturing a protective cap, comprising the steps of:

forming first and second sealing sections and a third section, wherein the first sealing section is directly adjacent the third section, wherein the third section has a larger outer diameter than an outer diameter of the first sealing section and outer diameter of the second sealing section, wherein the outer diameter of the first sealing section is larger than the outer diameter of the second sealing section, wherein the first sealing section is fittable into an end of a port terminator having one end which contains a center conductor pin and an opposite end which contains a bore which accommodates a security tool used to lock and unlock the port terminator from a port, and wherein the second sealing section is fittable into the opposite end of the port terminator; and forming a plurality of ridges on the first and second sealing sections; wherein the ridges are formed perpendicular to a plane of the third section of the protective cap.

9. A method according to claim 8, wherein the plurality of ridges are formed one-piece with the first and second sealing sections and the first and second sealing sections are formed one-piece with the third section of the protective cap.

10. A method of manufacturing a protective cap, comprising the step of forming first and second sealing sections and a third section, wherein the first sealing section is directly adjacent the third section, wherein the third section has a larger outer diameter than an outer diameter of the first sealing section and outer diameter of the second sealing section, wherein the outer diameter of the first sealing section is larger than the outer diameter of the second sealing section, wherein the first sealing section is fittable into an end of a port terminator having one end which contains a center conductor pin and an opposite end which contains a bore which accommodates a security tool used to lock and unlock the port terminator from a port, and wherein the second sealing section is fittable into the opposite end of the port terminator; wherein the first and second sealing sections are formed on opposite sides of the third section of the protective cap.

11. A method according to claim 8, wherein the protective cap is made of a plastic.

12. A method according to claim 8, wherein the protective cap is made of polyethylene.

13. A device according to claim 8, wherein the protective cap is made of metal.

* * * * *